United States Patent [19]

Lampka

[11] 4,286,343

[45] Sep. 1, 1981

[54] PARTITION-WALL ARRANGEMENT

[76] Inventor: Bruno Lampka, im Steinbichl 3, 8960 Kempton, Fed. Rep. of Germany

[21] Appl. No.: 127,532

[22] Filed: Mar. 5, 1980

[51] Int. Cl.[3] ..... A47K 3/22

[52] U.S. Cl. ..... 4/596; 4/599; 4/600; 4/606; 4/612; 4/607

[58] Field of Search ..... 4/596, 597, 599, 600, 4/612, 613, 661, 606, 607, 608; 52/109

[56] References Cited

U.S. PATENT DOCUMENTS

| | | | |
|---|---|---|---|
| Re. 28,613 | 11/1975 | Bolt | 4/600 |
| 1,566,387 | 12/1925 | Fifield | 4/600 |
| 1,732,798 | 10/1929 | Falzer | 4/608 |
| 1,990,871 | 2/1935 | Klocke | 4/600 |
| 2,481,397 | 9/1949 | Dalton, Jr. | 4/608 |
| 2,840,827 | 7/1958 | Calvano | 4/608 |
| 3,422,464 | 9/1970 | Hagar et al. | 52/109 X |
| 3,646,590 | 2/1972 | Bolt | 4/600 |
| 3,657,746 | 4/1972 | Downey | 4/599 |
| 3,862,459 | 1/1975 | Brunette | 4/606 |
| 3,869,734 | 3/1975 | Bolt et al. | 4/600 |
| 3,925,828 | 12/1975 | Kim | 4/599 |
| 4,020,519 | 5/1977 | Robison | 4/606 |
| 4,064,570 | 12/1977 | Kim | 4/600 |

*Primary Examiner*—Henry K. Artis
*Attorney, Agent, or Firm*—Haseltine & Lake

[57] ABSTRACT

A partition-wall arrangement comprises a hollow post which is stationary mountable on that corner of a bath or shower tub which is diagonally opposed to a room corner in which the tub is installed. The hollow post is mounted by clamping it between the tub and the room ceiling. The hollow post contains one or a pair of winding shafts at which a pair of flexible partition-walls is wound up, which can be extracted against the effect of a return spring respectively through a vertical slit or a pair of slits into directions which form a right angle with one another and can be connected in the extracted positions at opposed room walls.

8 Claims, 3 Drawing Figures

45
44
46
110
128
50
48
52
132
30
158
52
48
50
34

PARTITION-WALL ARRANGEMENT

BACKGROUND OF THE INVENTION

The invention relates to a partition arrangement for bath or shower tubs installed in room corners.

According to DE-U No. 73 06 736 a partition arrangement comprises ceiling guide rails mounted rectangularly from which flexible walls are suspended, at the front edges of which vertical magnetic bars being fastened, co-operating with one another to form an enclosed chamber.

BRIEF SUMMARY OF THE INVENTION

One object of the invention is to provide a single element which contains rectangularly extractable flexible walls without requiring ceiling rails and which can be easily installed avoiding any operations at the present room walls.

According to a further object of the invention the partition arrangement comprises a hollow post mountable on that corner of the tub which is diagonally opposed to said room corner and provided with a pair of flexible partition walls in the inner chamber of the hollow post; at least one vertical slit provided in one wall of the hollow post; at least one vertical shaft rotatably mounted in the chamber of the hollow post; at least one of said pair of flexible partition walls being fastened at and wound on said vertical shaft and being passed through said vertical slit; at an end portion of said flexible partition wall projecting out of the hollow post a vertical bar being fastened covering said vertical slit when the partition wall is wound up; the rotatable shaft being provided with means for winding up that partition wall; both partition walls of said pair of partition walls being extractable rectangularly with respect to one another; an adjusting device arranged at the upper and/or lower end of the hollow post for changing the overall length of which and a room ceiling fastening plate at the upper end of the post or the upper adjusting device of which.

According to this invention the pair of flexible walls can be wound up on a single rotatable shaft and that pair of flexible walls can be drawn through a single vertical slit. But according to preferred embodiments of the invention the hollow post is provided with a pair of vertical slits, each of said partition walls being passed through one of said slits, and further a pair of rotatable shafts is provided within said hollow post, each of which being connected with one of said partition walls. According to a further feature of the invention each rotatable shaft is provided with a return spring for winding up the partition wall.

DESCRIPTION OF THE PREFERRED EMBODIMENTS

Figure 1:
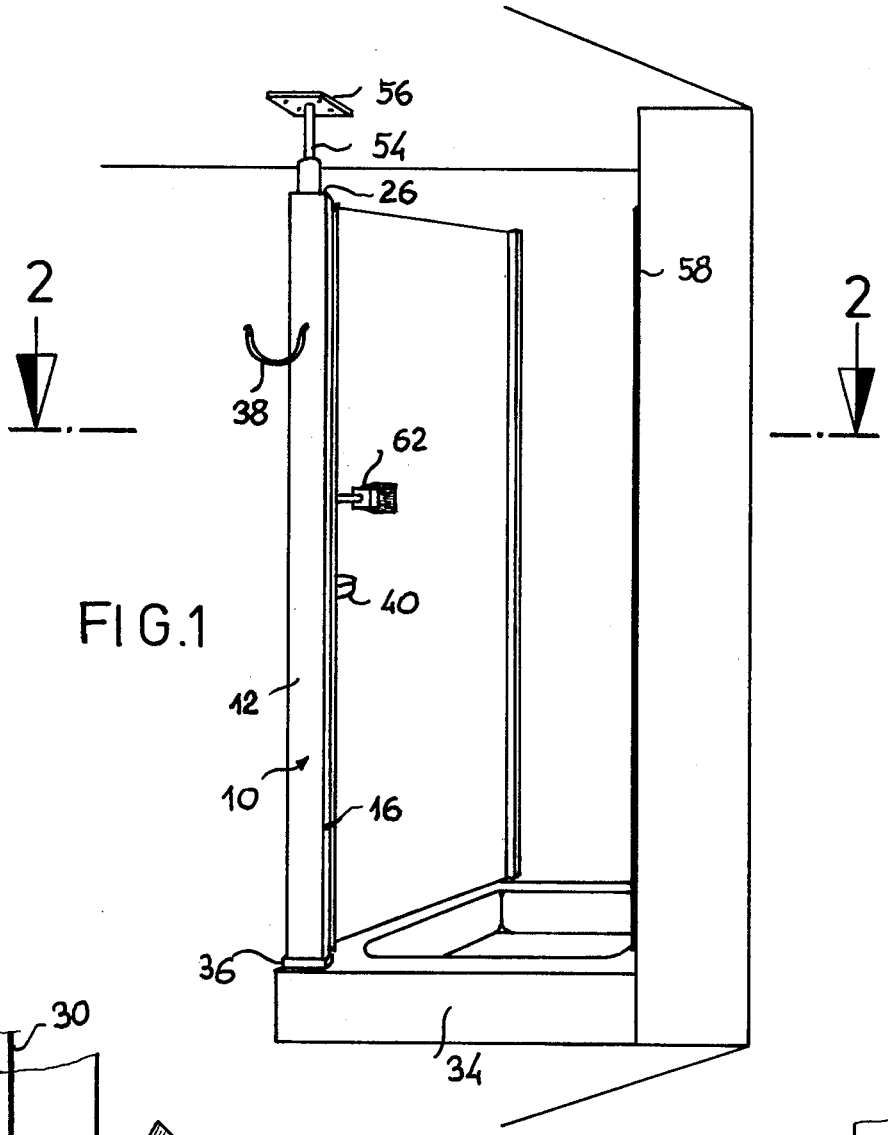
FIG. 1 shows a perspective view of one embodiment of a new partition wall arrangement.

According to FIG. 1 a hollow corner post 10 consists of an extruded profile element provided with a pair of side walls 12, 14 forming a right angle therebetween, a pair of shorter front walls 16, 18 each associated rectangularly to one of the side walls and a diagonal wall 20 connecting the pair of front walls. The post 10 further is provided with a lower end plate 24 and an upper end plate 26. Between the end plates 24, 26 a pair of parallel winding shafts 28, 28 are rotatably mounted. On each of the winding shafts a flexible wall 30 preferably of plastic film is wound up. Two longitudinally extending slits 22, 23 are provided in each of the front walls 16, 18. Each of the flexible walls 30, 30 leaves the hollow post through one of the pair of slits. The leading edges of the flexible walls are fastened at vertical end bars 32 respectively, covering the slits 22, 23 in the wound up position of the flexible walls.

Each shaft 28 is provided with an installed return spring as known per se from roller blinds which operates to wind up the flexible wall. The flexible walls 30 can be wound off independently from one another by drawing them out of the post 10 against the action of the return springs. Therefore the flexible walls always are in a tensioned state, and are drawn out forming a right angle between them and then are fastened at the opposed room walls respectively at which stationary magnetic bars 58 are fastened co-operating with the leading bars 32 of the flexible walls respectively. Also the leading bars 32 are provided with a magnetic strip at their leading surfaces respectively.

In order to open the shower chamber the leading bars 32 are removed from the stationary bars 58 and while supporting the bars 32 by hand the flexible walls are drawn into the hollow post and wound up on the shafts 38 automatically. The leading bars 32 are drawn tight against the front walls of the hollow post and held in place by the stress exerted by the spring installed in each shaft respectively. Therefore the slits 22, 23 are covered by the bars 32 respectively.

The hollow post 10 can be easily erected. On the corner of the shower tub lying diagonally opposed to the room corner a foot holder 36 is adhered having an inner profile corresponding to the outer profile of the post 10. The post can be inserted into the holder 36. Then the length adjusting device 54 is operated, which consists of a threaded spindle extending coaxially with the post and which can be screwed into and out of the post at the upper end of which. A fastening plate 56 is rotatably mounted at the upper end of the spindle. Therefore in order to assemble the post the spindle is rotated until the fastening plate 56 is pressed against the room ceiling. At the upper surface of the fastening plate a spike or spikes are provided impressing into the ceiling whereby the post is firmly held in vertical position. Additionally the fastening plate can be screwed on to the ceiling. For this purpose holes are provided in the fastening plate.

At the outer side wall surfaces 12 and/or 14 hooks 38 are provided at the post. At the inner diagonal wall 20 a soap dish 40 and above that a stationary brush 62 are fastened. The brush 62 is arranged on a holding arm 60 extending horizontally in the direction towards the room corner of the tub, so that a person can massage his body.

Figure 3:
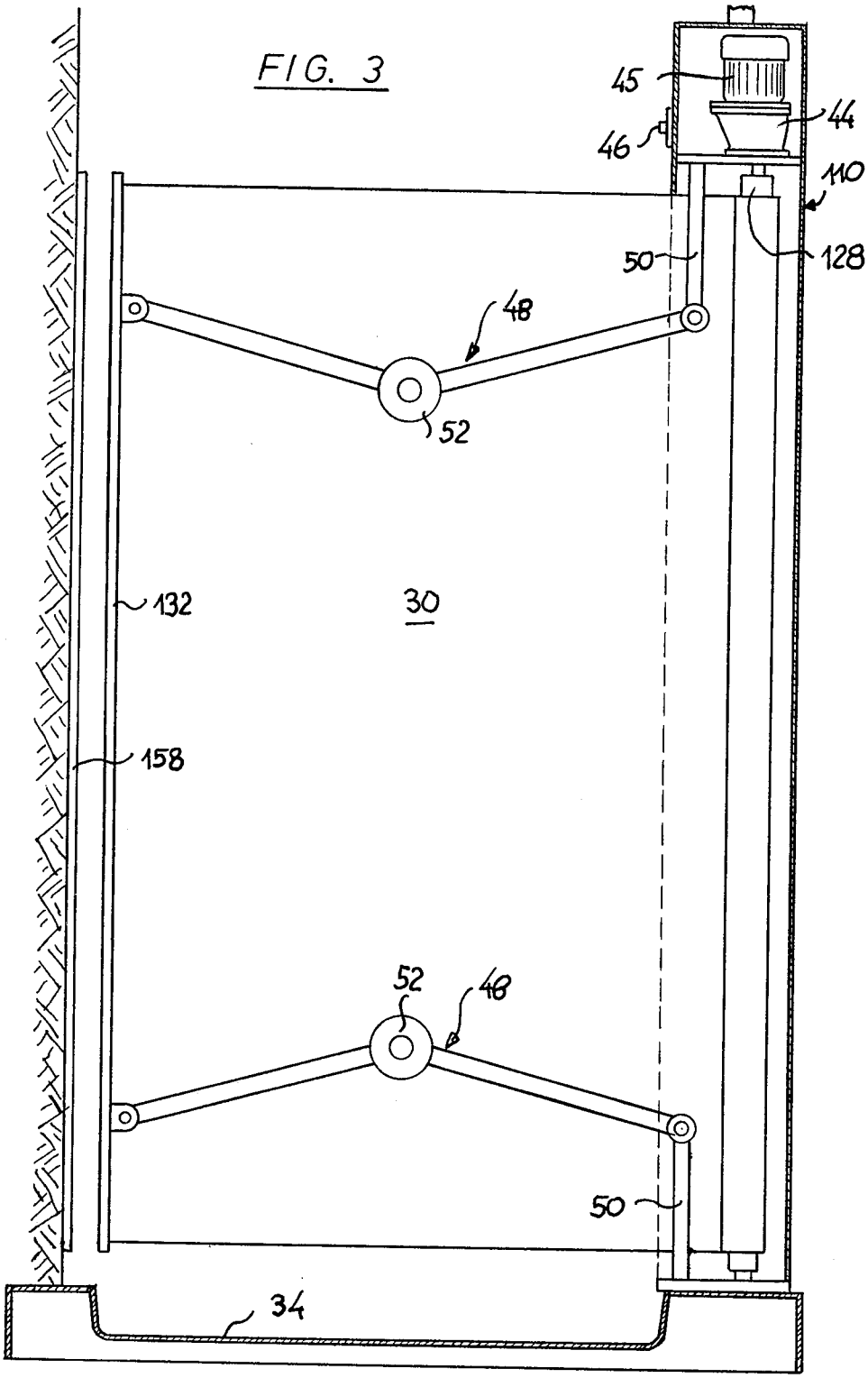
FIG. 3 shows a side view of a further embodiment of the invention.

In the embodiment of FIG. 3 the hollow post 110 is similar to the post 10 but elongated beyond the upper edge of the flexible wall 30. Within this elongated part of the post an electric motor 45 is mounted which is in driving connection with a pair of shafts 128 via a gear 44. At a pair of vertical struts 50 a pair of swinging arm arrangements 48 is hinged respectively. A leading bar 132 of the flexible wall is pivoted at the free ends of the swinging arms of the arrangements 48. The swinging arm arrangements form a pantograph structure. At the hinge of each pair of swinging arms forming that arrangement respectively a spreading spring is inserted. The spring (not shown) tends to pivot the swinging arms into an extended position in which they form an obtuse angle with one another.

A person having entered the shower compartment operates a switch 46 at the post 110, whereby the motor is energized allowing the spreading springs of the swinging arm arrangements to draw out the flexible walls in order to form the partitions. FIG. 3 shows a position immediately before the end position of the flexible wall is reached. In the end position the leading bar 132 comes in magnetic contact with the stationary room wall bar 158. The motor is stopped by means of a micro-switch or a time relay switch. When the switch 46 is operated again the motor 45 starts in opposite direction and winds up the flexible walls against the action of the spreading springs. The motor is stopped by a microswitch after the leading bar 132 has closed the slit of the post. In the embodiment of FIG. 3 the flexible wall need not be supported by hand.

Figure 2:
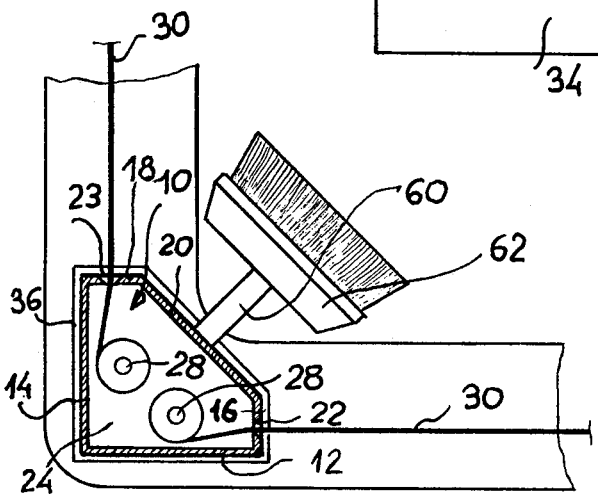
FIG. 2 shows a horizontal cross-section of the arrangement along line 2—2 of FIG. 1.
Figure 2:
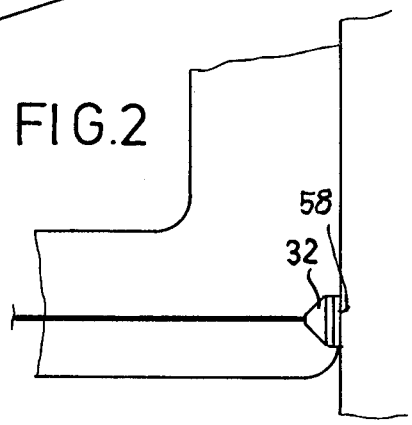

Different modifications are within the scope of the invention. The swinging arm arrangements 48 can also be used together with the embodiment shown in FIGS. 1 and 2, that means without a motor drive. Instead of a single motor as described above two separate motors can be used, each one for one of the shafts 128. This is necessary if the pair of flexible walls are of different lengths.

Last but not least it is in the scope of this invention to use a single shaft 28 or 128, on which both of said flexible walls 30, 30 are wound up simultaneously in overlying relationship. Also in a simple construction a post having only one outlet slit for one or both flexible walls can be provided.

I claim:

1. A partition arrangement for bath or shower tubs installed in room corners characterized by a hollow post mountable on that corner of the tub which is diagonally opposed to said room corner and provided with a pair of flexible partition walls in the inner chamber of the hollow post; at least one vertical slit provided in one wall of the hollow post; at least one vertical shaft rotatably mounted in the chamber of the hollow post; at least one of said pair of flexible partition walls being fastened at and wound on said vertical shaft and being passed through said vertical slit; at an end portion of said flexible partition wall projecting out of the hollow post a vertical bar being fastened covering said vertical slit when the partition wall is wound up; the rotatable shaft being provided with means for winding up that partition wall; both partition walls of said pair of partitions walls being extractable rectangularly with respect to one another; an adjusting device arranged at the upper and/or lower end of the hollow post for changing the overall length thereof and a room ceiling fastening plate at the upper end of the post or the upper adjusting device thereof.

2. A partition arrangement as claimed in claim 1, wherein the hollow post is provided with a pair of vertical slits, each of said partition walls being passed through one of said slits.

3. A partition arrangement as claimed in claim 1 or 2, wherein a pair of rotatable shafts is provided within said hollow post, each of said shafts being connected with one of said partition walls.

4. A partition arrangement as claimed in claim 1, wherein each rotatable shaft is provided with a return spring for winding up the partition wall.

5. A partition arrangement as claimed in claim 1, wherein the vertical bar is pivotably supported at an upper and a lower swinging arm arrangement pivotably mounted at the hollow post respectively forming a pantograph structure, each swinging arm arrangement being composed by a pair of swinging arms pivotably connected with one another, a spring being connected with the swinging arms forcing them into an extended position in which said swinging arms are substantially horizontally arranged and form an obtuse angle with one another.

6. A partition arrangement as claimed in claim 3, wherein each of the rotatable shafts is drivingly connected with a separate reversible electric motor.

7. A partition arrangement as claimed in claim 1, wherein the adjusting device comprises a vertical threaded spindle screwed into a tap hole provided in an upper and/or lower end plate of the hollow post.

8. A partition arrangement as claimed in claim 1, wherein the hollow post is provided with a stationary brush extending from an inner wall into a direction substantially bisecting the angle between said pair of extended partition walls, the hollow post further is provided with hooks at opposed outer side walls thereof.

* * * * *